US005862241A

United States Patent [19]

Nelson

[11] Patent Number: 5,862,241

[45] **Date of Patent: *Jan. 19, 1999**

[54] ADJUSTABLE HEADSET

[75] Inventor: Brian Nelson, Birchwood, Minn.

[73] Assignee: Telex Communications, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 642,757

[22] Filed: May 3, 1996

[51] Int. Cl.[6] ..... H04R 25/00

[52] U.S. Cl. ..... 381/379; 381/374

[58] Field of Search ..... 381/183, 187, 381/205, 370, 371, 374, 375, 376, 379, 383; 181/128, 129, 137; 2/209; 128/866, 864, 857; 379/430

[56] References Cited

U.S. PATENT DOCUMENTS

| | | | |
|---|---|---|---|
| Re. 30,662 | 6/1981 | Foley | 179/156 A |
| 1,579,412 | 4/1926 | Stenberg | 381/183 |
| 2,413,345 | 12/1946 | Gilman | 381/187 |
| 4,310,732 | 1/1982 | Stearns et al. | 179/156 A |
| 4,463,223 | 7/1984 | Yamanoi et al. | 179/156 R |
| 4,756,028 | 7/1988 | Scanlon | 2/209 |
| 4,783,822 | 11/1988 | Toole et al. | 381/187 |
| 4,821,323 | 4/1989 | Papiernik | 381/25 |
| 4,987,592 | 1/1991 | Flagg | 379/430 |
| 5,033,094 | 7/1991 | Hung | 381/183 |
| 5,117,465 | 5/1992 | MacDonald | 381/187 |
| 5,293,647 | 3/1994 | Mirmilshteyn et al. | 2/209 |

*Primary Examiner*—Huyen Le
*Attorney, Agent, or Firm*—Gregory P. Kaihoi

[57] ABSTRACT

A headset which is adjustable to two or more different levels of tightness. The headset includes a headband, and one or two earcups, each such earcup having an inner surface for engagement against the head of a user. At least one of the earcups includes a mounting bracket attaching the earcup to the headband. The mounting bracket is pivotally attached to the headband and to the earcup. An adjustment cam mechanism is associated with the headband and the mounting bracket for selectively adjusting the extent of outward pivotal movement of the mounting bracket with respect to the headband. This mechanism permits selective adjustment of the maximum at-rest distance from the inner surface of the earcup to the inner surface of the other earcup. Preferably the adjustment cam mechanism comprises a stop associated with an end of the headband, and a rotatable cam associated with the corresponding mounting bracket. The cam is engageable against the stop to limit the extent of outward pivotal movement of the first mounting bracket with respect to the headband. The cam may be rotated to two or more positions, making the headset adjustable to different degrees of tightness. The headset is comfortable for a range of head sizes and gives the headset user the ability to quickly and easily adjust the tightness of the earcups based on the conditions encountered, all without the use of tools.

12 Claims, 9 Drawing Sheets

ADJUSTABLE HEADSET

TECHNICAL FIELD

The invention relates to communications headsets, and particularly to adjustable communications headsets.

BACKGROUND OF THE INVENTION

In noisy environments, headsets having noise attenuating earcups are frequently used to facilitate communication by radio, intercom, etc. For example, aircraft pilots typically utilize headsets of the type having two noise attenuating earcups and a boom-type microphone. Similar headsets, having either one or two earcups, are frequently used in other settings, such as factories, stadiums, broadcast facilities, etc.

The passive noise attenuation capability of such headset earcups is significantly affected by the seal of the earcup noise attenuation ring against the user's head. The quality of that seal, in turn, is dependent on the amount of pressure exerted by the headset against the user's head—a tighter fit yields better attenuation, and a looser fit gives less attenuation. Tighter fitting headsets, however, can often be less comfortable. To balance comfort and noise attenuation effectiveness, most good quality headsets are adjustable to accommodate variations in the head sizes of potential users.

In some cases, once a headset is initially properly adjusted for a particular person no further adjustment of the headset is later required. Hence, many headsets, while being adjustable, are not easily adjusted. For example, some adjustable headsets require a tool of some type (such as a screwdriver, allen wrench, etc.) to make the adjustment. In other situations, however, periodic adjustment of the headset is required. For example, pilots usually own and use their own personal headset, but may find themselves in varying operating conditions. In one situation a pilot may be on a relatively noisy but short flight, and therefore might prefer to have a tight-fitting headset (to maximize noise attenuation). Although such a headset may not be very comfortable for long flights, on short flights the greater noise attenuation achieved by using a tighter headset may be a fair tradeoff against the slightly lower comfort of such a headset. In another situation, however, the same pilot may be on a longer flight in a quieter aircraft. In such a situation, the pilot may prefer the comfort of a looser fitting headset, even if it does not attenuate noise as well as a tighter fitting headset.

Accordingly, it would be desirable to provide convenient adjustability in the tightness of the fit of a communications headset. Many headsets provide adjustability in the length of the headband which connects the two earcups. Depending on the design, adjusting the length of the headband may incidentally also affect the tightness of the earcups on the user's head. In many cases, however, the headset is designed so that the headband is intended to rest on the top of the use's head, thereby at least partially supporting the weight of the headset. In such headsets, adjustment of the length of the headband therefore affects the alignment of the earcups with the user's ears, and the amount of weight carried by the headband. Accordingly, merely adjusting the length of the headband usually does not provide the desired degree of adjustability in the overall fit, earcup tightness, and comfort of the headset for the various noise environments described above. Some screw-type mechanisms have been utilized to provide adjustment of the degree of headset tightness, but such mechanisms often are found only in more expensive headsets. Moreover, such screw-type adjustment mechanisms often either require tools to make the adjustment (i.e., in order to make the adjustment mechanism inconspicuous), or utilize bulky knurl knobs for easier tool-free adjustment.

SUMMARY OF THE INVENTION

The invention provides a headset which is adjustable to two or more different degrees of tightness, making the headset more comfortable for a wider range of head sizes and giving the headset user the ability to quickly and easily adjust the tightness of the earcups based on the conditions encountered, all without the use of tools. The headset includes a headband and a pair of earcups, each earcup having an inner surface (typically a noise attenuation ring) for engagement against the head of a user. Each of the earcups includes a mounting bracket attaching the earcups to the headband. At least one of the mounting brackets is pivotally attached to the headband and to its earcup. An adjustment cam mechanism is associated with the headband and the mounting bracket for selectively adjusting the extent of outward pivotal movement of the mounting bracket with respect to the headband. This mechanism therefore permits selective adjustment of the maximum at-rest distance from the inner surface of one earcup to the inner surface of the other earcup, thus adjusting the tightness of the headset on the user's head.

In a preferred embodiment, the adjustment cam mechanism comprises a stop associated with an end of the headband, and a rotatable cam associated with the corresponding mounting bracket. The cam is engageable against the stop to limit the extent of outward pivotal movement of the mounting bracket with respect to the headband. Preferably the cam has a plurality of generally flat sides, the cam being rotatable to align a selected one of the flat sides with the stop for engagement with the stop. In a particularly preferred embodiment, the cam has four sides, and is eccentrically mounted to the mounting bracket, thereby providing several different tightness settings. The adjustment cam mechanism is economical to manufacture, and provides quick, easy adjustment to the desired degree of headset tightness.

DETAILED DESCRIPTION OF THE INVENTION

Figure 1:
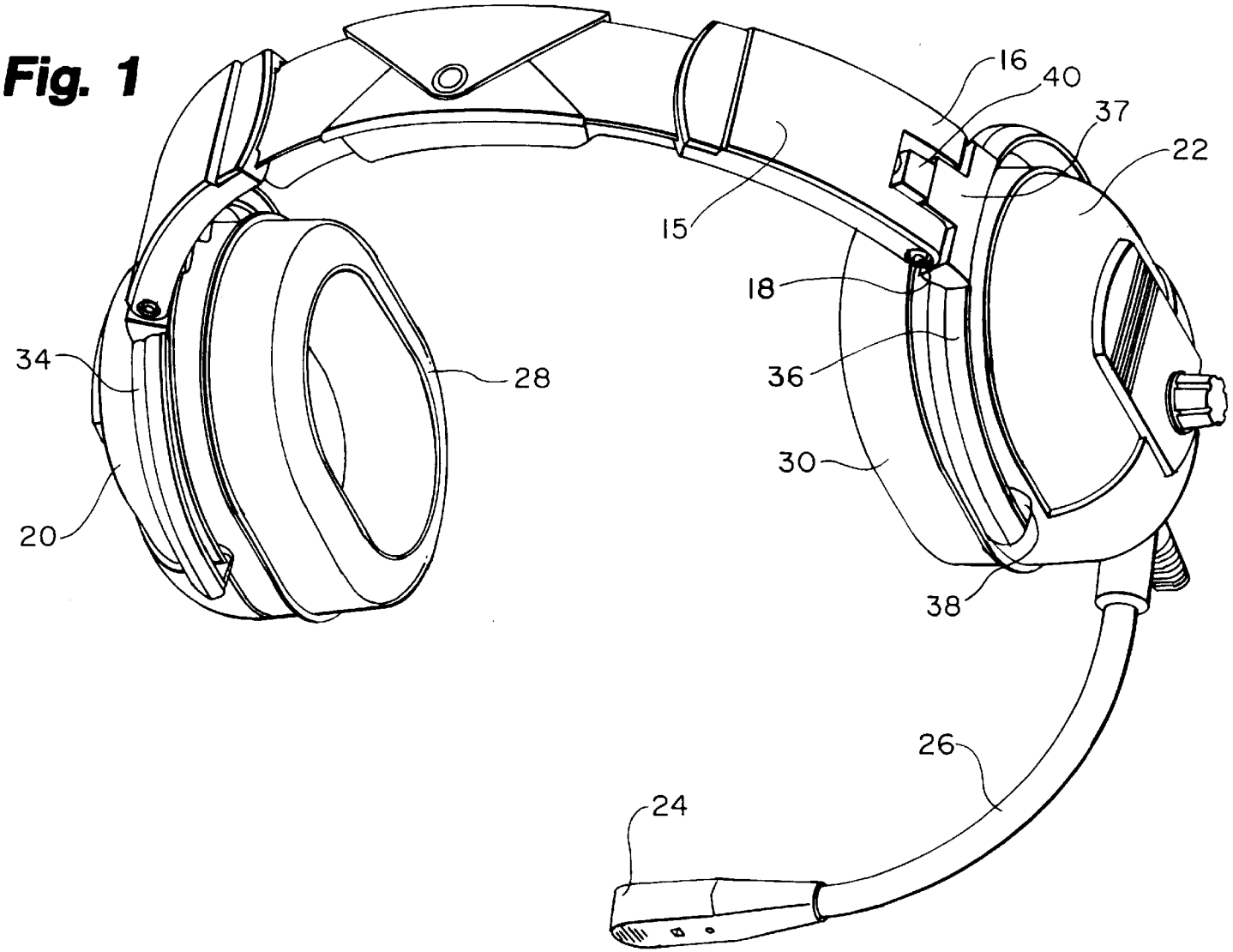
FIG. 1 is a perspective view of a headset of the invention.
Figure 2:
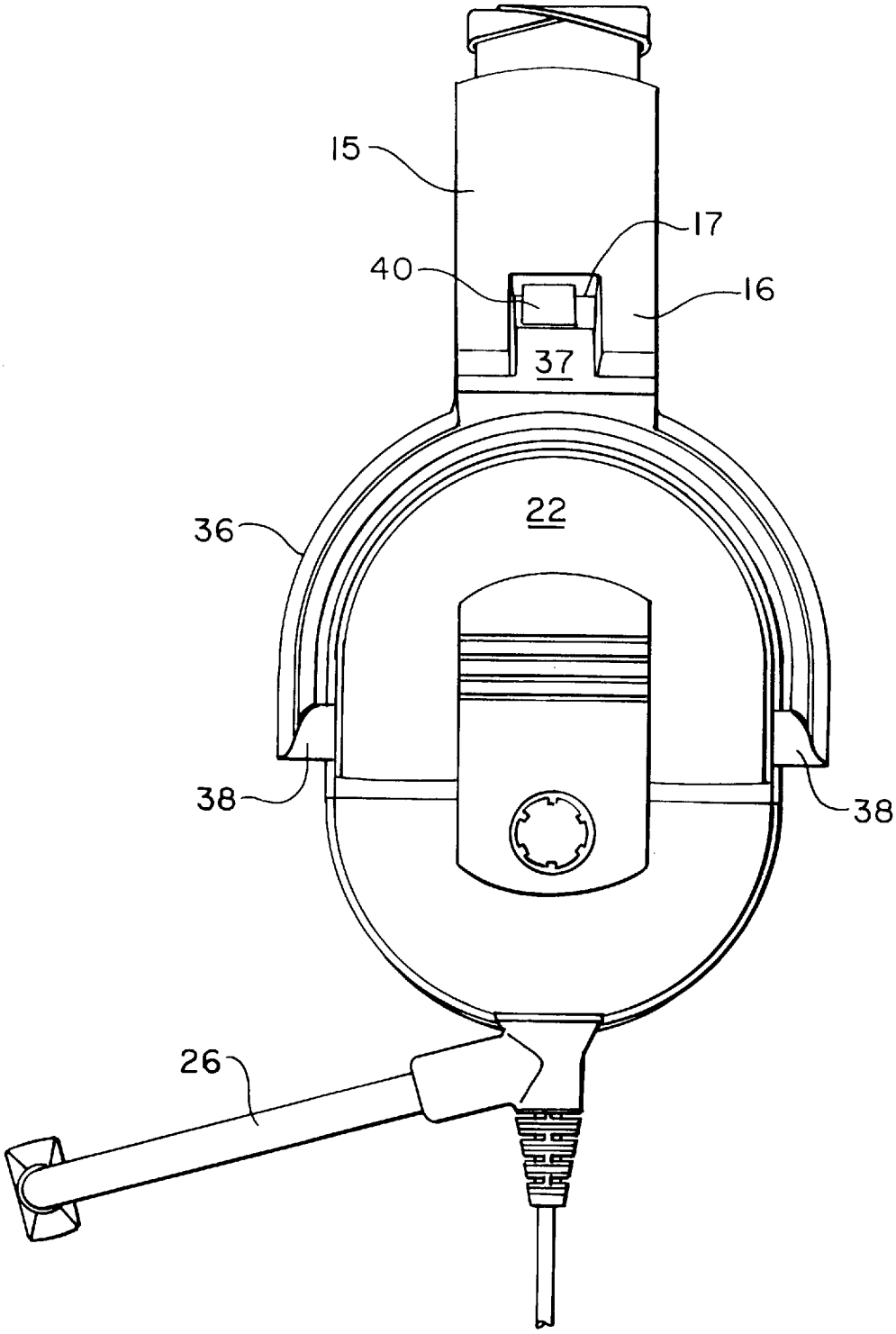
FIG. 2 is a side elevational view of a headset of the invention.

FIGS. 1–4 illustrate a preferred headset embodying the adjustment mechanism of the invention. This headset includes a pair of earcups 20, 22, connected by an adjustable headband 15, and a conventional microphone 24 carried by a microphone boom 26. It will be understood, however, that the invention is suitable for use on other communications units, including, for example, headphones (which have no microphone) or single sided headsets or headphones (i.e., which have a headband carrying a single earcup).

In the preferred headset illustrated, each of the earcups 20, 22 is attached to the headband 15 by a mounting bracket, 34, 36. The mounting brackets depicted are of the stirrup type, having pivotal connections 38 to the earcup, thereby permitting the earcup to pivot about a horizontal axis parallel to the line of sight of the user—these pivotal connections 38 are not necessary to utilization of the invention, but provide for greater comfort and a better seal of the ear cushions 28, 30 against the user's head, thus resulting in better noise attenuation. It will be appreciated, therefore, that the phrase "mounting bracket," as used herein, is meant to include both such stirrup-type brackets and any other mechanical connection of the earcup to the headband, including, for example, any structure which is integral to either the headband or the earcup.

Figure 3:
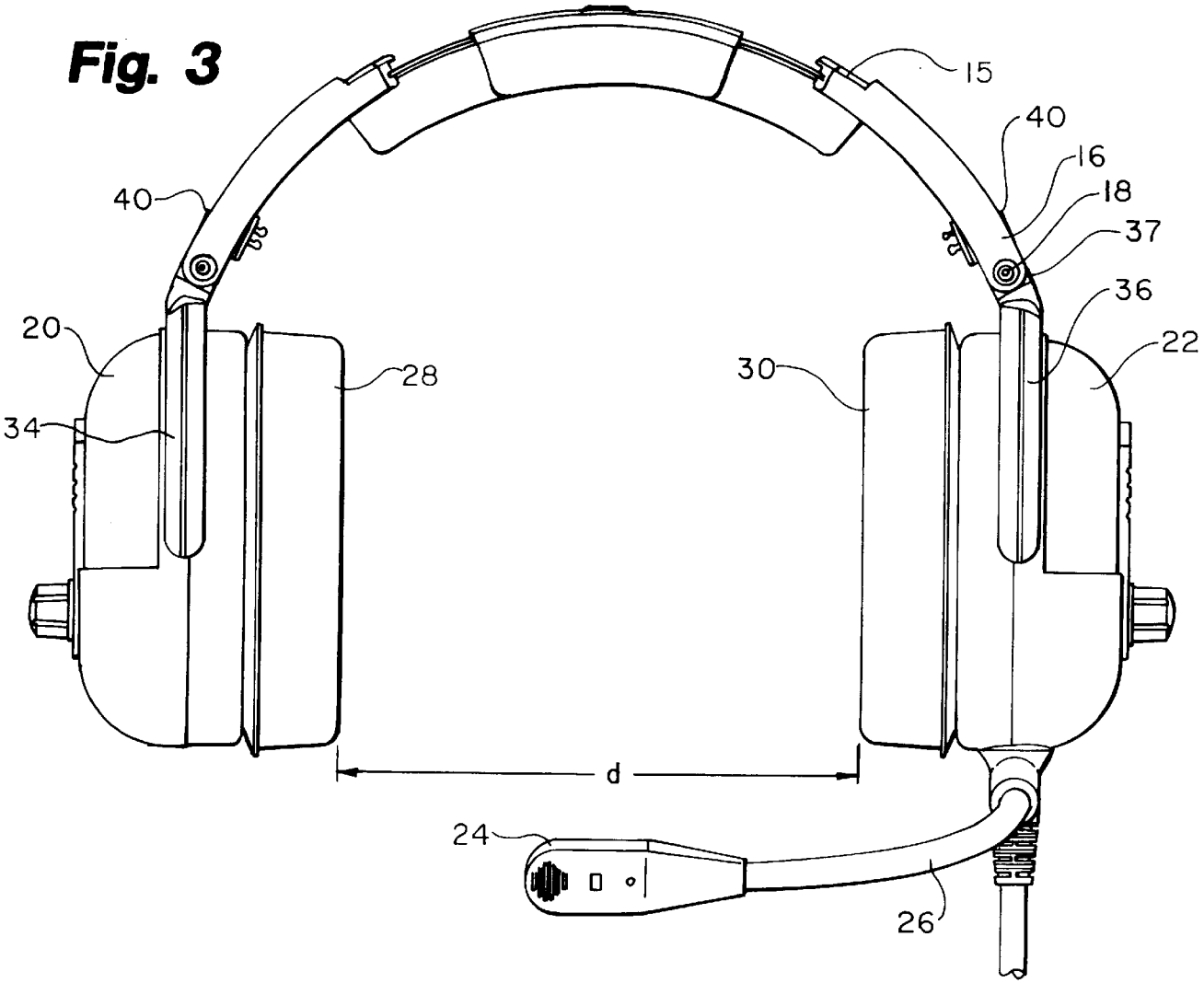
FIG. 3 is a front elevational view of a headset of the invention.
Figure 4:
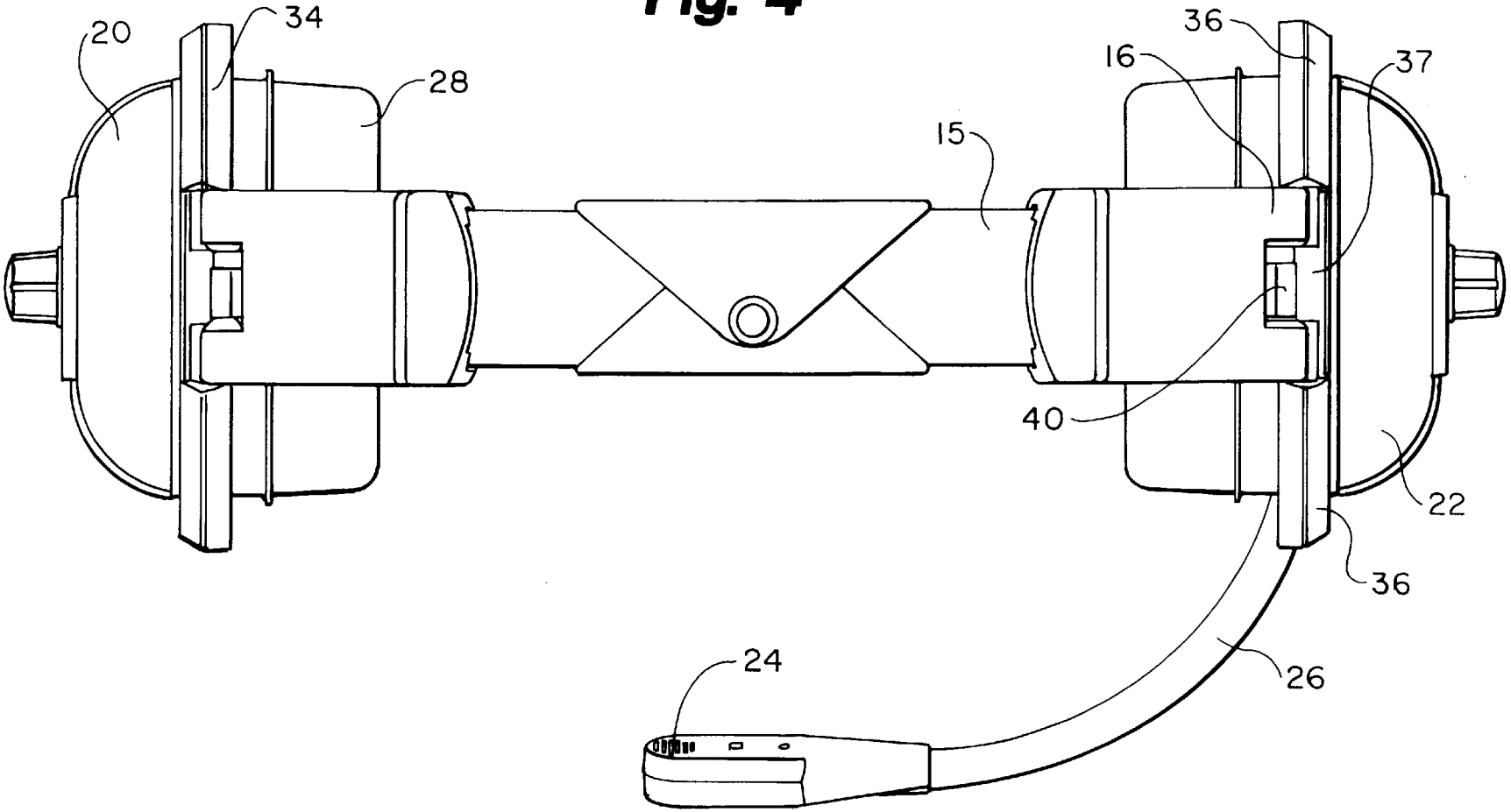
FIG. 4 is a top, plan view of a headset of the invention.

As can be seen from FIGS. 1 and 3, the length of the headband 15 may be adjustable to accommodate heads of different sizes. Because this type of headset may be relatively heavy, the headband is designed to rest on the top of the user's head—adjustment of the length of the headband 15 therefore permits the user to properly position the earcups 20, 22 with respect to the user's ears. Once this adjustment to the length of the headband 15 is made, however, it is also desirable to permit independent adjustment of the tightness of the headset on the user's head. This tightness is dependent on the "at-rest" distance "d" between the inner surfaces of the ear cushions 28, 30 carried by the earcups 20, 22.

An adjustment cam mechanism is therefore provided to permit adjustment of this "at-rest" distance. The cam mechanism is associated with an end of the headband 15 and the associated mounting bracket 36, and permits selective adjustment of the extent of outward pivotal movement of the mounting bracket 36 with respect to the headband 15. In the preferred embodiment illustrated in the drawings, the adjustment cam mechanism comprises a stop 17 associated with the headband 15, and a rotatable cam 40 associated with the mounting bracket 36, the cam 40 being engageable against the stop 17 to limit the extent of outward pivotal movement of the mounting bracket 36 with respect to the headband 15.

Figure 5:
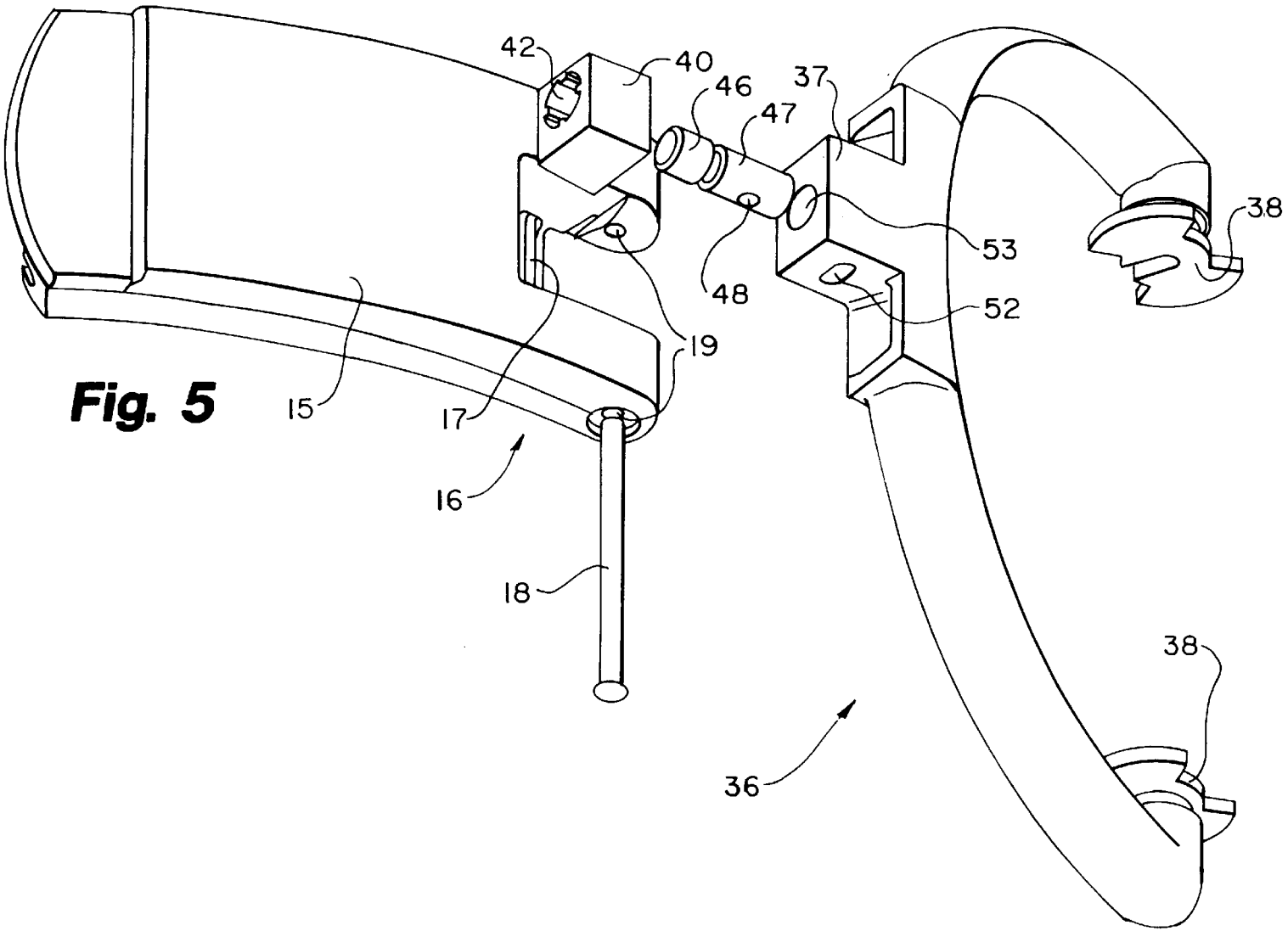
FIG. 5 is a broken-away, exploded view of the attachment of the headband to the earcup mounting bracket.

FIG. 5 illustrates a preferred configuration for the cam mechanism. The headband 15 terminates in a forked end 16, and a stop 17 is disposed between the legs of the forked end 16. The mounting bracket 36 includes an upwardly extending cam mounting tab 37, which has a hole 53 in which is received a cam pivot pin 46. The pivot pin 46 in turn is secured to this upwardly extending cam mounting tab 37 by passage of another pivot pin 18 through a hole 19 in the forked end 16 of the headband 15, through a transverse hole 52 in the mounting tab 37, and through the transverse hole 48 in the cam pivot pin 46. The mounting bracket 36 therefore can pivot about an axis defined by the pivot pin 18. By making the transverse hole 52 in the cam mounting tab 37 slightly wider than the diameter of the pivot pin 18, the mounting bracket is also permitted to pivot slightly about an axis defined by the cam mounting pivot pin 46, thereby providing full freedom of orientation for the ear cushion 30 to seal against the head of the user.

The cam 40 is pivotally secured to the cam pivot pin 46. As is illustrated in greater detail in FIGS. 6–10, preferably the cam includes an eccentrically positioned longitudinal hole 42. The cam also includes a pair of tabs 43 for engaging a circumferential groove 47 in the cam pivot pin 46—the tabs lock the cam to the pivot pin 46 but permit the cam 40 to be rotated about the pivot pin 46. The relative fit of the cam 40 on the pivot pin 46 should be loose enough to permit convenient manual manipulation of the cam 40, so it can be turned to the desired position, but tight enough that it will stay in the selected position. In the preferred cam shown in the drawings, this is accomplished by providing four lands 44 which engage the surface of the cam pivot pin 46.

Figure 7A:
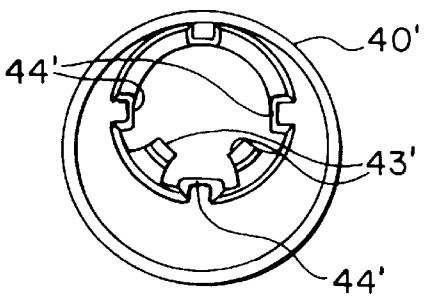
FIG. 7A is a top, plan view of an alternate, round rotatable cam.
Figure 7:
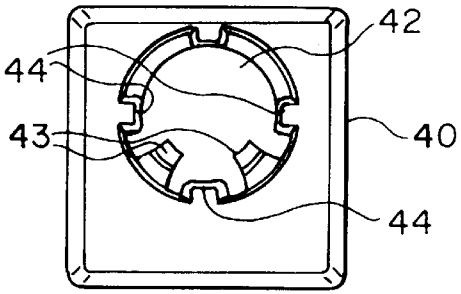
FIG. 7 is a top, plan view of the rotatable cam of FIG. 5.
Figure 6:
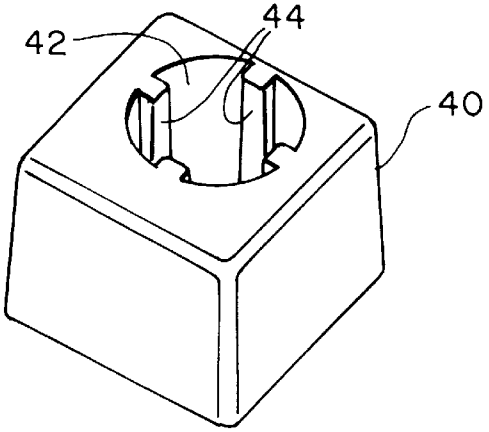
FIG. 6 is a perspective view of a rotatable cam usable in a headset of the invention.
Figure 10:
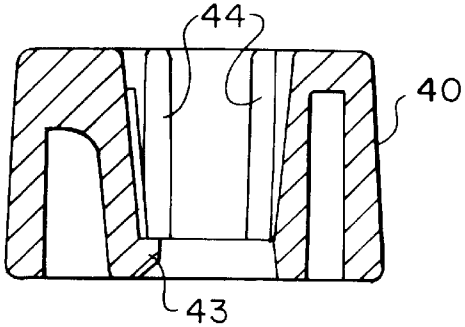
FIG. 10 is a cross-sectional view of FIG. 8, taken along lines 10—10 thereof.
Figure 9:
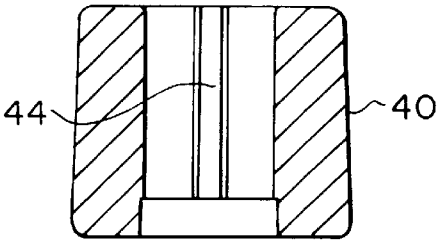
FIG. 9 is a cross-sectional view of FIG. 8, taken along lines 9—9 thereof.
Figure 8:
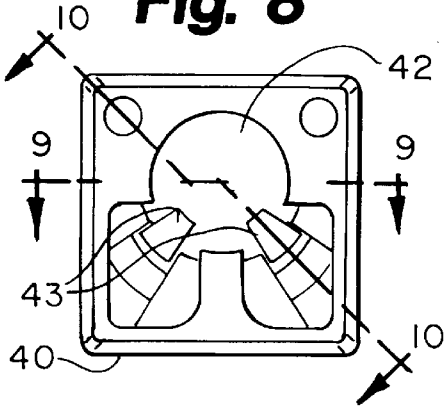
FIG. 8 is a bottom, plan view of the rotatable cam of FIG. 5.

Although other shapes could be utilized, the preferred cam 40 illustrated in the drawings has four generally flat sides, and is rotatable to align a selected one of the flat sides with the headband stop 17. Two of the sides (the left and right sides in FIG. 7) are the same distance from the center of the hole 42, and each of the other two sides are a different distance from the center of the hole 42, thereby providing three different adjustment positions for the cam. It will be appreciated that other shapes could also be utilized, such as, e.g., three or five sides, or even a round cam 40' as illustrate in FIG. 7A. Utilizing flat sides, however, generally assures that the cam will not inadvertently rotate to an undesired position during use. It will also be appreciated that, while the drawings illustrate the cam as mounted to the earcup mounting bracket and the corresponding stop 17 carried by the headband, the reverse orientation would also be functional—i.e., the cam could be mounted to the headband, and the stop carried by the earcup or earcup mounting bracket. Moreover, the adjustment cam mechanism may be utilized on just one end of the headband; preferably, however, two such mechanisms are utilized, one being associated with each earcup.

Figure 11:
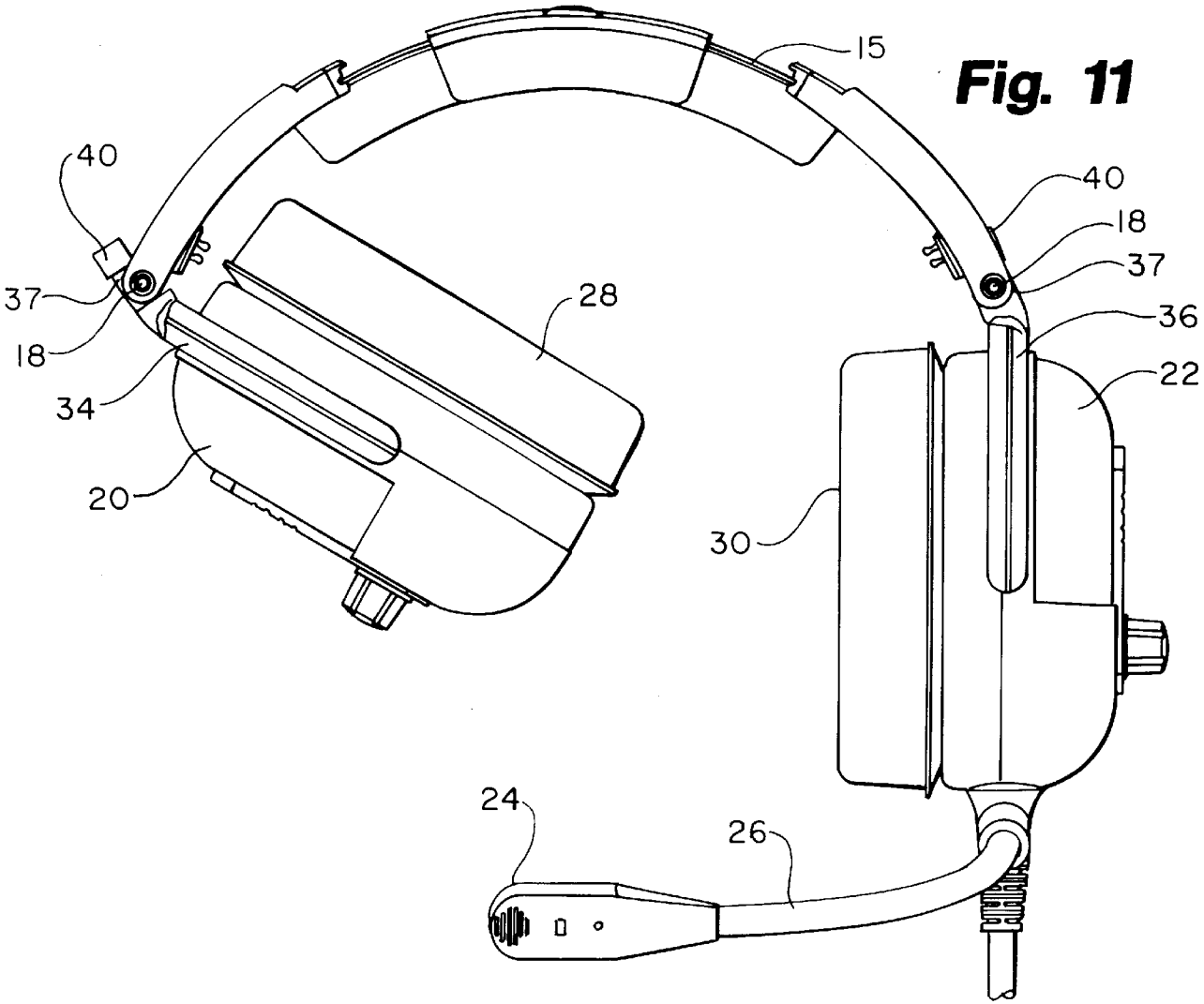
FIG. 11 is a front elevational view the headset of FIG. 3 shown in a moved position.
Figure 12:
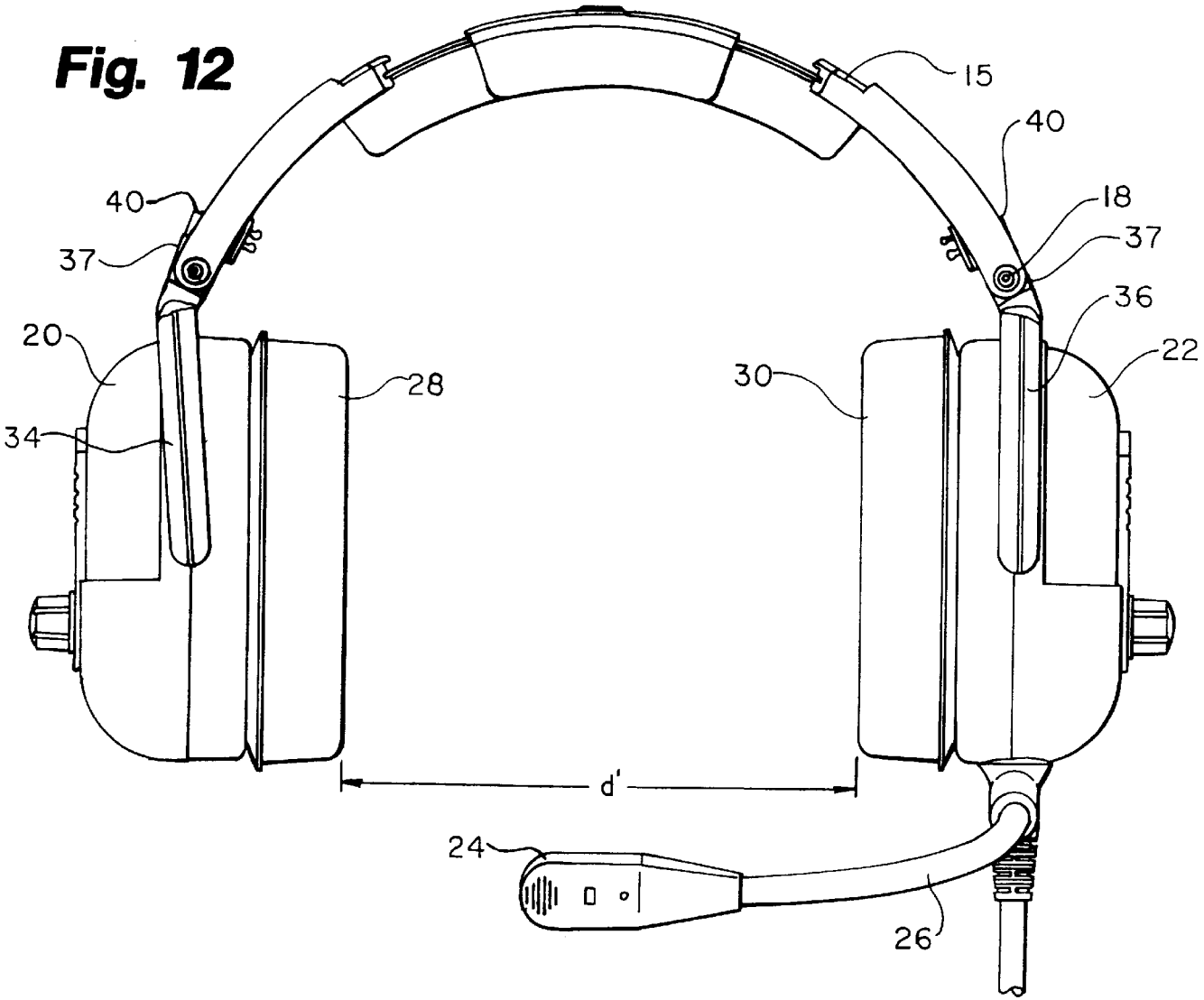
FIG. 12 is another front elevational view depicting the headset of FIG. 3 in another moved position.

FIGS. 11–12 illustrate the use and operation of the invention. In FIG. 11, the mounting bracket 34 for the left earcup 20 has been pivoted inwardly around the axis defined by the pivot pin 18. This pivotal motion rotates the cam 40 away from the stop associated with the headband 15. The cam 40 may then be rotated about the cam pivot pin 46 to the desired position, and the mounting bracket may then be returned to its "at-rest" position for use. As shown in FIG. 12, the cam 40 associated with the left mounting bracket 34 and earcup 20 has been rotated to a position where its "thick" side is toward the stop 17 on the headband 15—this position of the cam 40 limits the degree of outward pivotal movement of the bracket 34 with respect to the headband 15, so that the distance d' between the ear cushions 28 and 30 is now less than the distance d depicted in the configuration of the headset depicted in FIG. 3. Similar adjustment of the cam associated with the right earcup 22 enables the user to further decrease the distance d'.

Figure 13:
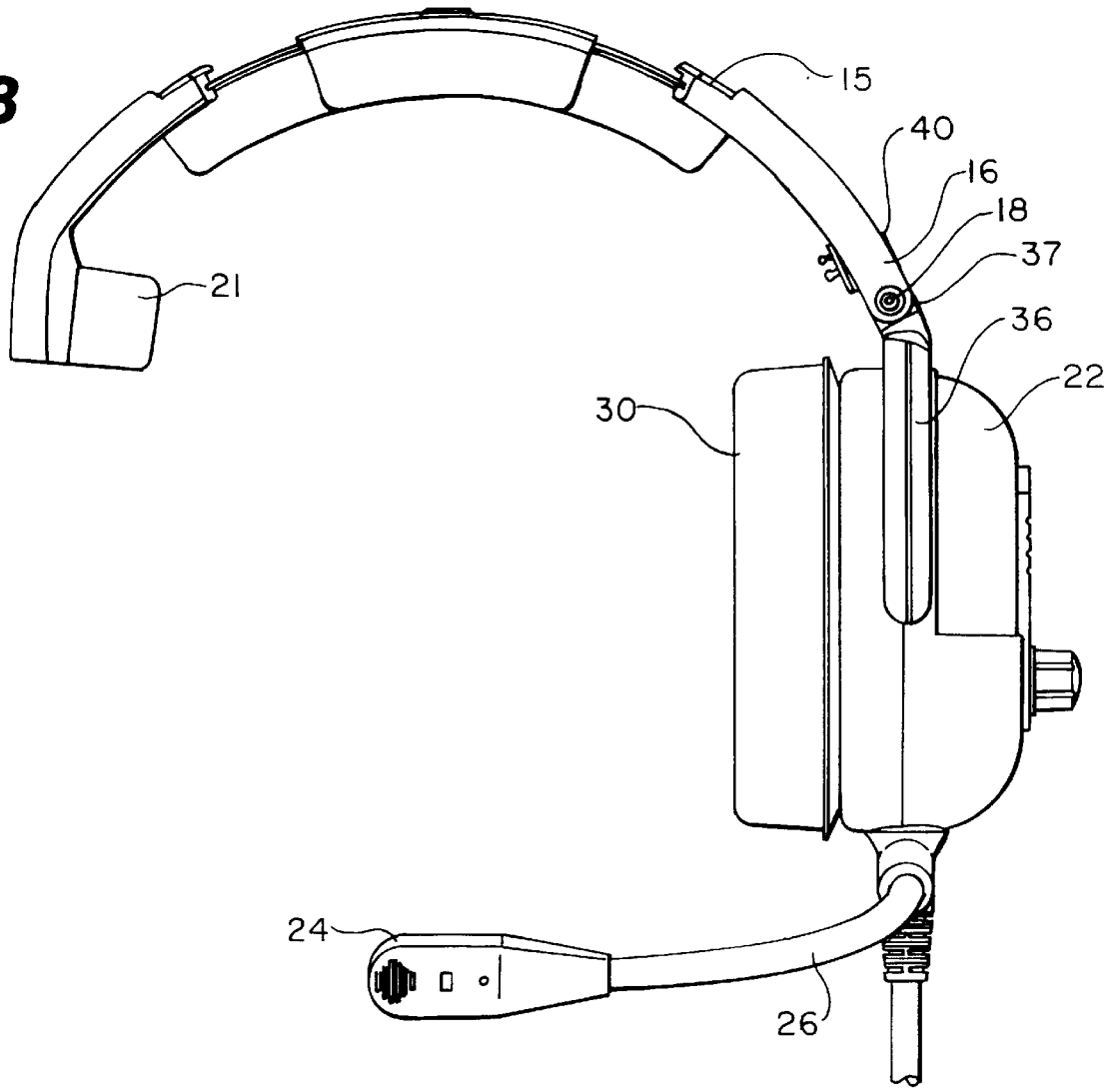
FIG. 13 is a front elevational view of an alternate embodiment depicting a headset with a single earcup.

FIG. 13 depicts an alternate embodiment of the invention. In this embodiment, the communications headset is a single sided headset, i.e., a headset with a headband carrying a single earcup. A cushion 21 is attached at the other end of the headband for engagement with the user's head just above the ear.

While a preferred embodiment of the present invention has been described, it should be understood that various changes, adaptations and modifications may be made therein without departing from the spirit of the invention and the scope of the appended claims.

What is claimed is:

1. An adjustable headset comprising:

a headband;

first and second earcups, each earcup having an inner surface for engagement against the head of a user;

first and second mounting brackets attaching the first and second earcups, respectively, to the headband;

the first mounting bracket being pivotally attached to the headband and to the first earcup, permitting inward and outward pivotal movement of the first mounting bracket with respect the headband about a generally horizontal axis; and an adjustment cam mechanism associated with the headband and the first mounting bracket for selectively adjusting the extent of outward pivotal movement of the first mounting bracket with respect to the headband, such mechanism therefore permitting selective adjustment of the maximum at-rest distance from the inner surface of the first earcup to the inner surface of the second earcup.

2. The adjustable headset of claim 1 wherein the adjustment cam mechanism comprises a stop associated with the headband, and a rotatable cam associated with the first mounting bracket, the rotatable cam being engageable against the stop to limit the extent of outward pivotal movement of the first mounting bracket with respect to the headband.

3. The adjustable headset of claim 2 wherein the rotatable cam has a plurality of generally flat sides, the cam being rotatable to align a selected one of the flat sides with the stop for engagement with the stop.

4. The adjustable headset of claim 3 wherein the cam has four sides, and is eccentrically mounted to the mounting bracket.

5. The adjustable headset of claim 1 wherein the adjustment cam mechanism comprises a stop associated with the first mounting bracket, and a rotatable cam associated with the headband, the cam being engageable against the stop to limit the extent of outward pivotal movement of the first mounting bracket with respect to the headband.

6. An adjustable headset comprising:

a headband having first and second ends;

an earcup;

a mounting bracket pivotally attaching the first end of the headband to the earcup, permitting inward and outward pivotal movement of the mounting bracket with respect the headband about a generally horizontal axis; and an adjustment cam mechanism associated with the headband and the mounting bracket for selectively adjusting the extent of outward pivotal movement of the mounting bracket with respect to the headband.

7. The adjustable headset of claim 6 wherein the adjustment cam mechanism comprises a stop and a rotatable cam, one of such elements being associated with the headband and the other being associated with the mounting bracket, the rotatable cam being engageable against the stop to limit the extent of outward pivotal movement of the mounting bracket with respect to the headband.

8. The adjustable headset of claim 7 wherein the rotatable cam has a plurality of generally flat sides, the rotatable cam being rotatable to align a selected one of the flat sides with the stop for engagement with the stop.

9. The adjustable headset of claim 7 wherein the rotatable cam is eccentrically mounted to the mounting bracket.

10. The adjustable headset of claim 9 wherein the rotatable cam has four generally flat sides.

11. The adjustable headset of claim 7 wherein the rotatable cam is generally round in cross-section.

12. An adjustable headset comprising:

a headband having opposing ends;

first and second earcups, each earcup having an inner surface for engagement against the head of a user;

first and second mounting brackets, the first mounting bracket pivotally attaching one end of the headband to the first earcup, permitting inward and outward pivotal movement of the first mounting bracket with respect the headband about a generally horizontal axis, and the second mounting bracket pivotally attaching the other end of the headband to the second earcup, permitting inward and outward pivotal movement of the second mounting bracket with respect the headband about a generally horizontal axis; and an adjustment cam mechanism associated with each mounting bracket, each adjustment cam mechanism comprising a stop associated with the headband, and a rotatable cam associated with the mounting bracket, the rotatable cam having four generally flat sides and being eccentrically and rotatably mounted to the mounting bracket, thereby permitting a selected one of the flat sides to be aligned with the stop for engagement with the stop to limit the extent of outward pivotal movement of the mounting bracket with respect to the headband, such mechanism therefore permitting selective adjustment of the maximum at-rest distance from the inner surface of the first earcup to the inner surface of the second earcup.

* * * * *